US010034525B2

(12) United States Patent
Morelli Carullo

(10) Patent No.: US 10,034,525 B2
(45) Date of Patent: Jul. 31, 2018

(54) FOLDING BOX

(71) Applicant: Tissot S.A., Le Locle (CH)

(72) Inventor: Beatrice Morelli Carullo, Le Locle (CH)

(73) Assignee: Tissot S.A., Le Locle (CH)

( * ) Notice: Subject to any disclaimer, the term of this patent is extended or adjusted under 35 U.S.C. 154(b) by 1010 days.

(21) Appl. No.: 14/363,659

(22) PCT Filed: Nov. 23, 2012

(86) PCT No.: PCT/EP2012/073498
§ 371 (c)(1),
(2) Date: Jun. 6, 2014

(87) PCT Pub. No.: WO2013/083420
PCT Pub. Date: Jun. 13, 2013

(65) Prior Publication Data

US 2014/0318992 A1 Oct. 30, 2014

(30) Foreign Application Priority Data

Dec. 9, 2011 (EP) ..... 11192708

(51) Int. Cl.
*B65D 5/00* (2006.01)
*A45C 11/16* (2006.01)
(Continued)

(52) U.S. Cl.
CPC ..... *A45C 11/16* (2013.01); *B65D 5/327* (2013.01); *B65D 5/36* (2013.01)

(58) Field of Classification Search
CPC ..... A45C 11/16; B65D 5/36; B65D 5/327; B65D 5/422; B65D 5/4801; B65D 5/48018; B65D 5/6626
(Continued)

(56) References Cited

U.S. PATENT DOCUMENTS 930,114 A * 8/1909 Adams ..... B65D 5/36 229/117.01
1,145,668 A * 7/1915 Brown ..... B65D 5/36 229/103.2
(Continued)

FOREIGN PATENT DOCUMENTS

EP 0 489 606 6/1992
EP 1 228 971 8/2002
(Continued)

OTHER PUBLICATIONS

International Search Report dated Feb. 14, 2013 in PCT/EP12/073498 Filed Nov. 23, 2012.

*Primary Examiner* — Ernesto Grano
(74) *Attorney, Agent, or Firm* — Oblon, McClelland, Maier & Neustadt, L.L.P.

(57) ABSTRACT

Folding box (1) for a piece of jewellery or timepiece, including a foldable blank (2) with a packaging band (3) having a direction (D) movable between an unfolded position in a plane (P) and a folded position, and including two flaps (31; 32) movable in relation to a base (30).
It includes a foldable structure (4), movable between a folded position parallel to said plane (P) and a stable unfolded position, including a base face (40) fixed to said base (30) or forming said base, and two bearing surfaces (51; 52) each for receiving in abutment one of said flaps (31; 32) in said unfolded position of said foldable structure (4),
Said foldable structure (4) is foldably movable, between the flat folded position and stable unfolded position, around a folding crease (46) which is oblique with respect to said direction (D), forming one edge of said base face (40).

17 Claims, 5 Drawing Sheets

(51) Int. Cl.
*B65D 5/32* (2006.01)
*B65D 5/36* (2006.01)

(58) Field of Classification Search
USPC ..... 206/6.1; 229/228, 122.24, 120.18
See application file for complete search history.

(56) References Cited

U.S. PATENT DOCUMENTS 2,078,906 A * 4/1937 Kondolf ..... B65D 5/48018 229/120.18
3,088,648 A * 5/1963 Fobiano ..... B65D 5/302 229/120.18
3,352,474 A * 11/1967 Racer ..... B65D 5/08 229/149
4,214,696 A * 7/1980 Barton ..... B65D 5/48018 229/103.3
5,873,457 A 2/1999 Madweb
5,887,705 A * 3/1999 Renevey ..... A47F 7/03 206/566
6,786,331 B1 * 9/2004 Zucchini ..... B65D 5/422 206/232
7,311,196 B2 * 12/2007 Kim ..... A47F 7/12 206/278
D590,710 S * 4/2009 Mittelstaedt ..... D3/297
8,573,471 B2 * 11/2013 Wong ..... B65D 5/241 229/117.08
2002/0036230 A1 * 3/2002 Chevalier ..... B65D 5/2095 229/228
2002/0070146 A1 * 6/2002 Freeze ..... B65D 5/0227 206/768
2004/0140345 A1 * 7/2004 Kao ..... B65D 5/3657 229/117.07
2006/0191801 A1 8/2006 Herzog
2010/0006632 A1 * 1/2010 Conroy ..... B65D 5/248 229/120.18
2010/0314436 A1 * 12/2010 Tao ..... B65D 5/324 229/122.24
2013/0161377 A1 * 6/2013 Nebeker ..... B65D 5/322 229/116.5
2016/0159515 A1 * 6/2016 Putko ..... B65D 5/6661 206/278

FOREIGN PATENT DOCUMENTS

EP 1 733 972 12/2006
EP 2 078 680 7/2009
FR 2 665 881 2/1992
FR 2 678 583 1/1993
FR 2 907 427 4/2008

* cited by examiner

A
A
D
D
P
P1
F

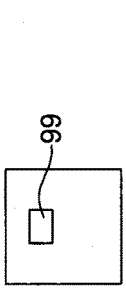
Fig. 16
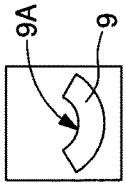
Fig. 15A
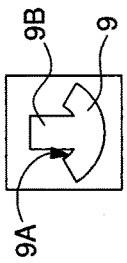
Fig. 15
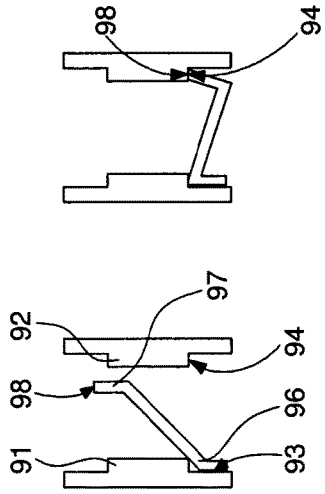
Fig. 18
Fig. 17
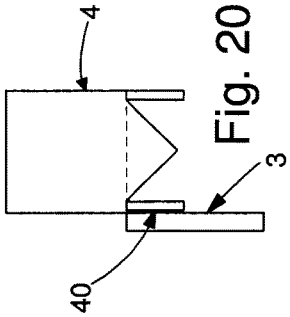
Fig. 20
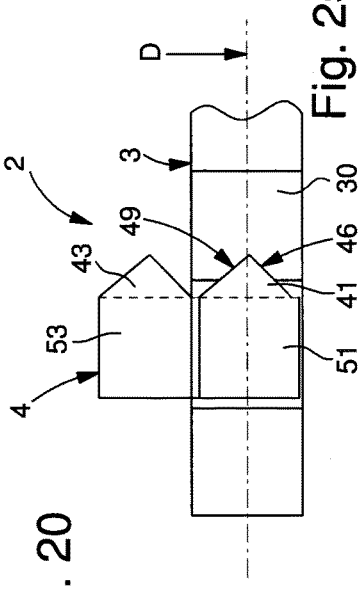
Fig. 25
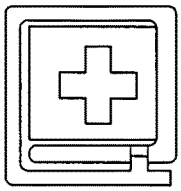
Fig. 24
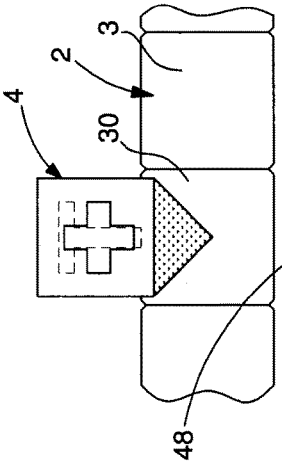
Fig. 19
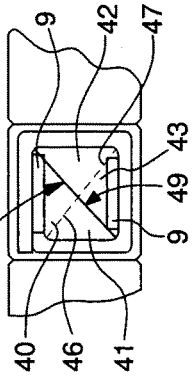
Fig. 21
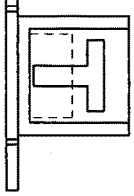
Fig. 22
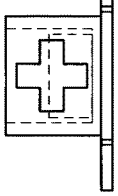
Fig. 23

FOLDING BOX

CROSS-REFERENCE TO RELATED APPLICATIONS

This is a National phase application in the United States of International Patent Application PCT/EP2012/073498 filed Nov. 23, 2012 which claims priority on European Patent Application No. 111192708.3 filed Dec. 9, 2011. The entire disclosures of each of the above patent application are hereby incorporated by reference.

FIELD OF THE INVENTION

The invention concerns a folding box for the packaging of at least one object or piece of jewellery or timepiece, said box including a foldable blank which includes at least one packaging band extending in a longitudinal direction and movable between a flat, unfolded position in a base plane and a folded position, and comprising, on either side of a base, two flaps which are angularly movable in relation to said base.

The invention concerns the field of packaging objects, and more specifically the field of boxes, or packages for the transport or storage of timepieces or pieces of jewellery.

BACKGROUND OF THE INVENTION

Packaging objects, particularly pieces of jewellery or timepieces requires the provision of proper protection of the object.

Padding is normally used for this purpose, but the padding is generally not multi-purpose, or it does not protect the object properly, It is preferable to move the object away from the walls of the case or box, to protect it from any shocks or stresses to which the box is subjected.

In the particular case of pieces of jewellery or timepieces of substantially toric shape, it is known to use cushions on which the objects are placed, however the cushion itself has to be held in place, by being fitted inside a cavity, or by placing padding on either side of the cushion.

Good packaging is relatively complex, includes several components, and may be expensive with respect to the cost of the object to be protected.

Creating packaging with a moderate production cost devised to offer optimum protection of the timepiece or piece of jewellery is thus a permanent preoccupation of timepiece/jewellery manufacturers, especially since the cases or boxes are retained throughout the lifetime of the object. It is therefore necessary to observe a traditional mode of presentation and to propose a simple, refined packaging, worthy of the object it contains.

Double packaging provides a good solution to the problem of protection, with the object contained within a first box which is in turn confined within a second box. The object is properly protected, but double packaging is expensive, and the user does not have immediate access to the object.

Cases with hinged covers are also quite expensive solutions.

Cardboard type packaging exists which answers the requirement for protection with the choice of a sufficiently thick material. Cardboard packaging also has the advantage of being affordable, and can accommodate any type of decoration. Pre-assembled cardboard boxes take up storage space. The advantage of foldable cardboard packaging is flat storage, which saves space, combined with a lower cost than that of pre-assembled cardboard packaging, because no assembly labour is required. However, it is often difficult to keep the packaging in an unfolded position, unless flaps or tabs are used, which are unattractive and deteriorate over time after a certain number of manipulations, or without accepting a reduction in the internal volume available for housing the folds or double walls, or similar, required by the kinematic of folding and unfolding.

French Patent Application No 2678583 in the name of EDITH HERMAN describes a display case packaging formed from a single blank with a folding system around a square base. However, this simple case includes gussets occupying part of the internal volume, EP Patent Application No 1228971 in the name of KRAFFT GOEBEL presents a shock resistant case wherein the product to be protected is held by Z-shaped wing flaps exhibiting a certain elasticity.

EP Patent No 0489606B1 in the name of HRICOVINI EVA describes a family of cardboard boxes closed by partially open tetrahedrons which are folded down over the opening for the insertion of the contents.

FR Patent Application No 2665881A1 in the name of RICHEZ NICOLE describes a folding packaging cooperating with a folding display case in the form of two independent parts, which is the usual configuration for a jewellery box or case. U.S. Pat. No. 5,873,457A in the name of MADWED MARK discloses the holding of an object of toric shape, such as a watch, around a cross member inserted into two opposite openings in a case with a hinged cover forming a box, said cross member being operated like a drawer to either secure or release the watch from its box, as required.

U.S. Patent No 20060191801 in the name of JACK HERZOG discloses, in a similar manner, a case with a hinged cover, including a hollow compartment for receiving a watch, wherein the watch may or may not be secured to the case by a through elastic pin.

Known foldable boxes all have the same tendency to collapse onto themselves, and cannot maintain a right angled geometry without the presence of a false bottom or cushioning.

In short, there exist few low cost boxes, which can be stored flat and are capable of offering good protection to a timepiece or similar, while having an elegant attractive appearance with no projecting or fragile elements.

SUMMARY OF THE INVENTION

The invention proposes to overcome the drawbacks of known technologies and ensure that quality is maintained in a more economical packaging which includes the fewest possible components. More specifically, the invention is devised for holding precious objects of substantially toric shape, and is very versatile, easy to assemble and suitable for high quality packaging for all types of objects.

Thus, the invention concerns a folding box for the packaging of at least one object or piece of jewellery or timepiece, said box including a foldable blank which includes at least one packaging band extending in a longitudinal direction and movable between a flat, unfolded position in a base plane and a folded position, and comprising, on either side of a base, two flaps which are angularly movable in relation to said base, characterized in that said foldable blank further includes a single-piece foldable structure, movable between a flat, folded position parallel to said base plane and a stable, unfolded position, said foldable structure including a base face secured in a permanent manner to said base or forming said base, and at least two bearing faces which, in said unfolded position of said foldable structure, are each arranged to receive and support one of said flaps, and further characterized in that said foldable structure is foldably movable, between said first flat, folded position and said stable, unfolded position thereof, around a folding crease which is oblique with respect to said longitudinal direction, said folding crease forming an edge of said base surface and further characterized in that two opposite faces comprised in said foldable structure each include, projecting onto the inner face thereof when said foldable structure is in said stable unfolded position, at least one cross support, which is arranged to receive a cross member for receiving a said object, said cross member having a length equal to the internal space of said faces carrying said cross supports so as to reinforce the holding of said foldable structure in said stable unfolded position.

According to a feature of the invention, said foldable structure includes an even number of visible faces, which are adjacent to said bearing faces and alternated therewith, and form, with said bearing faces, a polygonal prism in said unfolded position of said foldable structure, and form therewith a closed band foldable on two parallel levels in said flat, folded position of said foldable structure.

According to a feature of the invention, to ensure its stability in said stable, unfolded position, said foldable structure includes a plurality of polygonal sectors each adjacent to one of said bearing faces or to one of said visible faces, said polygonal sectors being, in said stable unfolded position, joined edge-to-edge to each other, either by folds, or by edges, locking them onto each other over the thickness of their constituent material, and so as to form together a polygonal surface corresponding to the cross-section of said polygonal prism, and further characterized in that one of said polygonal sectors is said base face and in that one of said folds is said folding crease.

According to a feature of the invention, said polygonal prism has a square cross-section, and said polygonal sectors are mutually identical prisms whose cross-section is a small equilateral right triangle wherein the hypotenuse of each corresponds to a junction fold with a respective face of said foldable structure.

According to a feature of the invention, said polygonal sectors are connected in pairs by a said fold to form, each time, in said stable unfolded position of said foldable structure, a prism whose cross-section is a large equilateral right triangle whose surface is double said small triangles, the two said thus formed large triangles being contiguous with each other at two said edges in said unfolded position.

According to a feature of the invention, said foldable structure extends, in said flat, folded position parallel to said base plane, in a direction parallel to said longitudinal direction with which said folding crease forms an angle of 45°.

According to a feature of the invention, said polygonal prism forms the framework of a rectangular parallelepiped whose base is formed by said base and whose cover is formed by a flap comprised in said packaging band.

According to a feature of the invention, said packaging band includes, at both ends thereof in said longitudinal direction, two closing flaps arranged to move into superposition on each other when said packaging band is in said folded position where it surrounds said foldable structure in its stable, unfolded position, said closing flaps including mutually complementary locking means to ensure said packaging band is held in position wound around said foldable structure.

According to a feature of the invention, at least one cross support includes a stop surface arranged to cooperate with one end of a flexible arm secured to the opposite face to that carrying said cross support, so as to hold said flexible arm in a buttress position between said opposite faces in said stable unfolded position of said foldable structure, to prevent said faces moving closer to each other.

According to a feature of the invention, said packaging band and said single-piece foldable structure are made of cardboard, and said folds are grooved.

BRIEF DESCRIPTION OF THE DRAWINGS

Other features and advantages of the invention will appear upon reading the following detailed description, with reference to the annexed drawings, in which:

FIG. 4 shows a schematic face view of a variant of a blank for creating the foldable structure, which

FIG. 11 shows a schematic top view of the assembled box with the foldable structure completely unfolded in a stable unfolded position on a base comprised in the packaging band, which is shown in the unfolded position, before the bands starts to be folded which is shown in FIG. 1.

FIG. 12 shows a schematic view parallel to faces comprised in the foldable structure, a step of deploying said structure between the positions illustrated in FIGS. 9 and 11, and FIG. 13 is a corresponding top view, in a parallel direction to the same said faces, while FIG. 14 is a corresponding end and side view.

FIG. 15 is a schematic face view of one of the faces of the foldable structure seen from the inner side when the structure is in the unfolded position, said face carrying a cross support projecting inwards, with a surface for receiving a cross member which includes an angular position indexing lug, while FIG. 16 shows a variant wherein the cross support is a portion cut into the thickness of the face concerned; FIG. 15A illustrates a variant of the cross support, with a continuous surface for receiving a cross member.

FIG. 17 is a schematic, partial view along a cross-section along plane AA of FIG. 11, of a variant wherein a flexible arm, which is represented by a dot and dash line in FIG. 11, is fixed to one of the two opposite faces, on the inner side, and FIG. 18, which is similar, shows the straight flexible arm in a buttress position under a cross support comprised in the face opposite the face to which it is fixed.

FIG. 19 partially illustrates, in a similar manner to FIG. 9, a variant of the foldable structure created from the blank of FIG. 4, shown in an end view in FIG. 20 before being turned over, in the turned over position in FIG. 21 and then in a corresponding top view in FIG. 22 and bottom view in FIG. 23, with FIG. 24 showing a face view of the closed box.

FIG. 25 shows, in a similar manner to FIG. 9, a variant wherein the foldable structure in the flat state extends in a perpendicular direction to that of the packaging band.

In FIG. 26 the packaging band is unfolded and in FIG. 27 the packaging band is folded around the unfolded foldable structure.

DETAILED DESCRIPTION OF PREFERRED EMBODIMENTS

Figure 1:
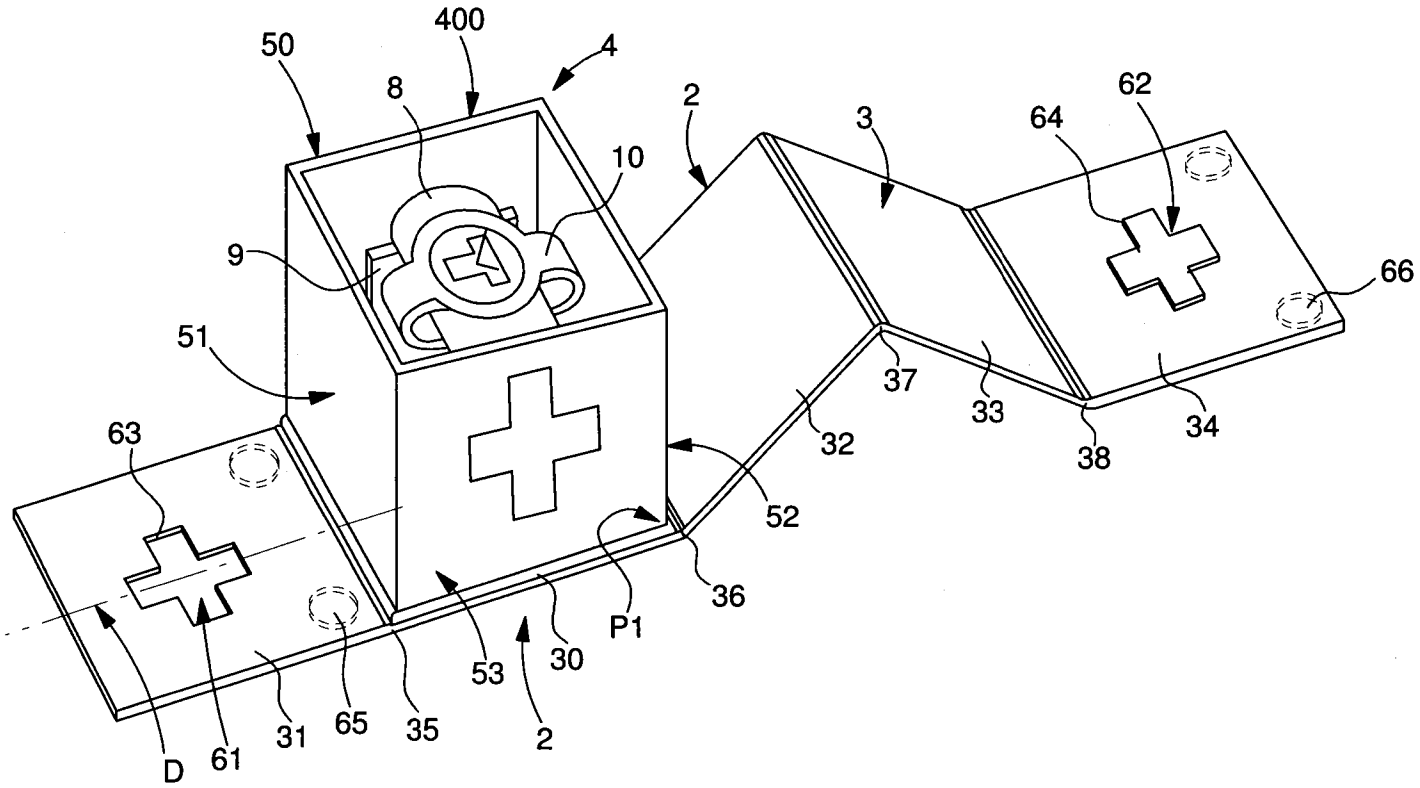
FIG. 1 shows a schematic perspective view of a box according to the invention, including a packaging band shown in a substantially flat, unfolded position, as it is starting to be wound around a foldable structure which is in a stable unfolded position, and which contains a cross member holding a timepiece, in this case a watch.
Figure 3:
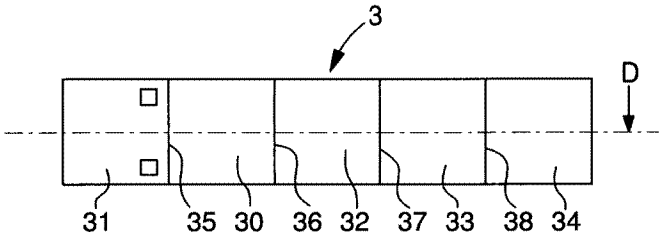
FIG. 3 shows a schematic face view of the packaging band in the flat, unfolded position.
Figure 4:
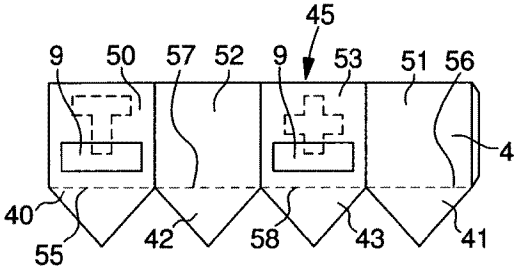
Figure 5:
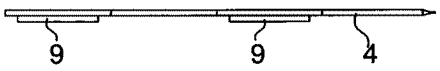
FIG. 5 shows in a top view.

The invention concerns the field of the packaging of objects, and more specifically the field of boxes, particularly for the field of horology or jewellery. It also concerns packaging for the transport or storage of objects, particularly for timepieces or pieces of jewellery.

"Box" will be used hereinafter to mean any packaging intended for the sale, handling or storage of these objects.

The invention more particularly concerns objects 10, particularly pieces of jewellery or timepieces. These objects 10 may be of various geometries, and may be fixed to a support, or closed within a chamber, or, in a particular application of the invention, "toric" shaped, i.e. objects forming, in the closed state for those having a variable geometry, a ring or a torus, and which can be fitted around a support or closed around a support. More specifically, and in a non-limiting manner, the invention is applicable to objects 10 which are wristwatches, or bracelets, or rings. These objects will be generally referred to hereinafter by the term "object 10".

Thus, the invention concerns a folding box 1 for at least one object 10, or a piece of jewellery or a timepiece or wristwatch or bracelet or ring, preferably for at least one toric-shaped object 10.

The invention is more precisely described here, in a non-limiting manner, in a thick cardboard embodiment, with creases for the folds and decorated. This embodiment is both economical, solid and attractive. The invention can also be made using other materials, such as leather or imitation leather, thin wood, coated textile, sheet metal, or a metal sandwich compound formed of aluminium sheets or similar material.

This folding box 1 includes a foldable blank 2. This foldable blank 2 includes at least one packaging band 3, which extends in a longitudinal direction D, and which is movable between a flat unfolded position in a base plane P, and a folded position. Packaging band 3 includes, on either side of a base 30, two flaps 31, 32, which are angularly movable in relation to base 30.

According to the invention, foldable blank 2 also includes a single-piece foldable structure 4, which is movable between a flat folded position parallel to base plane P, and a stable unfolded position. The Figures illustrate embodiments with bonded lugs which may or may not be visible. Bonding regions are represented in the Figures by a network of dots.

This foldable structure 4 includes a base face 40 permanently fixed to base 30 or forming base 30. It also includes at least two bearing faces 51, 52, which are arranged, in the unfolded position of foldable structure 4, to each receive in abutment one of flaps 31, 32 of packaging band 3.

According to the invention, foldable structure 4 is foldably movable, between its flat folded position and its stable unfolded position, around a folding crease 46, which is oblique with respect to longitudinal direction D. This folding crease 46 forms one edge of base face 40.

In a preferred embodiment, and as seen in the Figures, foldable structure 4 includes a preferably even number of other visible faces 53, 50, which are adjacent to bearing faces 51, 52, and alternated therewith, and form, with said bearing faces 51, 52, a polygonal prism in the unfolded position of foldable structure 4. These visible faces 53, 50 form, with support faces 51, 52, a closed band that can be folded down on two parallel levels in the flat folded position of foldable structure 4.

To ensure its stability in its stable unfolded position, foldable structure 4 includes a plurality of polygonal sectors 40, 41, 42, 43, which are each adjacent to one of bearing faces 51, 52, or to one of visible faces 53, 54.

In the stable unfolded position, these polygonal sectors are joined edge-to-edge to each other, either by folds 46, 47, or by edges 48, 49 clamped on top of each other on the thickness of their constituent material, and so as to form together a polygonal surface corresponding to the cross-section of the polygonal prism formed by the faces in the unfolded position of foldable structure 4.

Advantageously, one of these polygonal sectors is base face 40 and one of the folds is the folding crease 46.

In a preferred and non-limiting embodiment, illustrated by the Figures, the polygonal prism has a square cross-section, and polygonal sectors 40, 41, 42, 43, are then mutually identical prisms whose cross-section is a small equilateral rectangular triangle. The hypotenuse of each of these small triangles corresponds to a junction fold 55, 56, 57, 58, with a respective face 50, 51, 52, 53 of foldable structure 4.

In the preferred variant, as seen in FIGS. 6 to 14, polygonal sectors 40, 41, 42, 43 are connected in pairs by a fold 46, 47 of this type to form each time, in the stable unfolded position of foldable structure 4, a prism whose cross-section is a large equilateral rectangular triangle whose surface is double the small triangles, the two thus formed large triangles being contiguous with each other at two edges 48, 49 in the unfolded position. It is thus seen that small triangles 40 and 41, joined by fold 46, form a large triangle of this type, as do small triangles 42 and 43 joined by fold 47. Edges 48 and 49 form a diagonal of the square forming the cross-section of the square prism, whereas folds 46 and 47 form together the other diagonal. The small triangles may be joined to each other by adhesive bonding, a hinge or similar method, the small triangles may also be produced by folding a large triangle fixed in a suitable manner, in space, to the two faces which border said triangle.

Figures 11, 12, 13, 14:
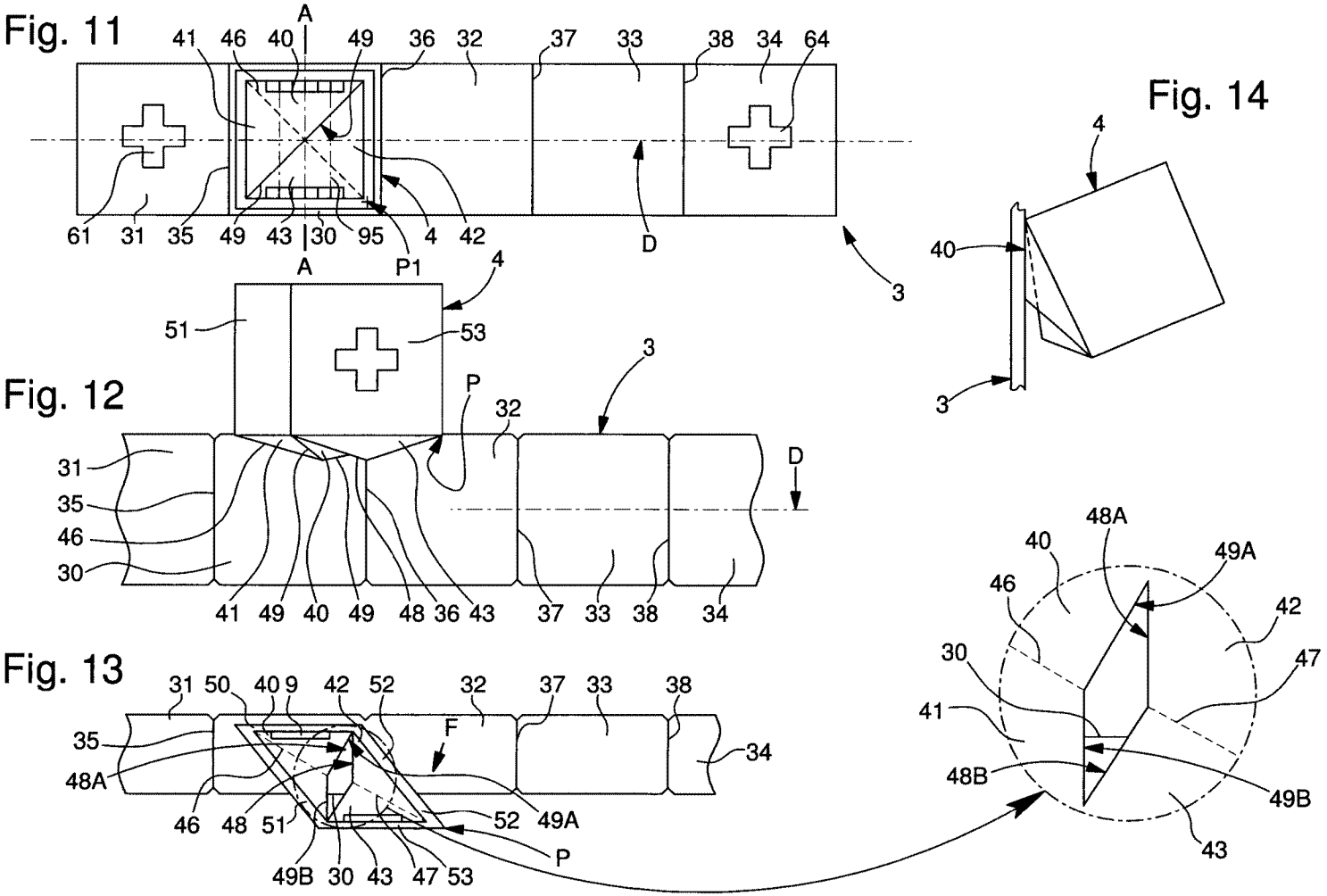

FIGS. 12 and 13 show that, during the unfolding of foldable structure 4 from the flat folded position to the stable unfolded position, each of edges 48, 49 is formed of two segments, respectively 48A, 48B and 49A, 49B, which form together, in projection in the plane of FIG. 13 which is perpendicular to all of faces 50, 51, 52, 53 of foldable structure 4, a deformable rhomboid, which shrinks as the structure moves in the direction of arrow F, which is a combined movement of several rotations.

Figure 9:
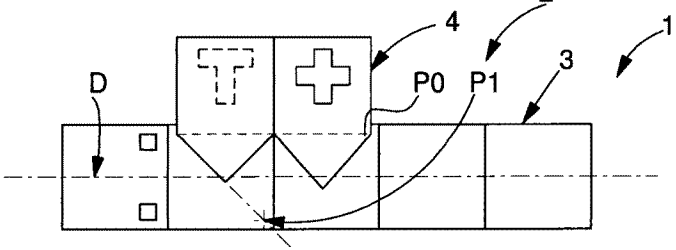
FIG. 9 shows a schematic face view of the folding box assembled in its storage position, with the foldable structure folded and bonded flat onto the unfolded packaging band.
Figure 10:
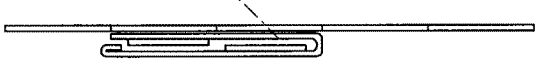
FIG. 10 is the corresponding top view.
Figure 2:
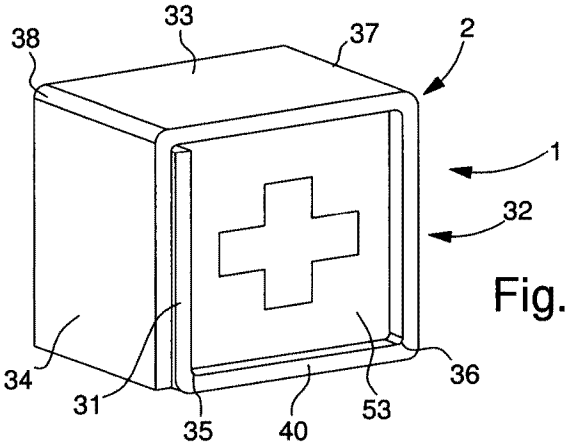
FIG. 2 shows a schematic perspective view of the box of FIG. 1 completely folded and closed, with the packaging band shown in a folded position, entirely wound around the foldable structure, with the end flaps held fixed one on top of the other.
Figure 6:
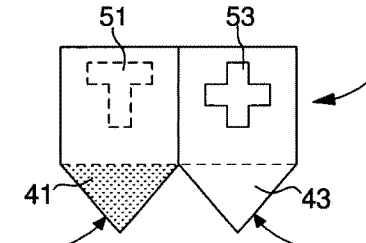
FIG. 6 shows a schematic face view of the foldable structure bonded onto itself so as to form a closed band, shown folded flat and occupying two substantially parallel levels.
Figure 7:
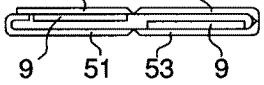
FIG. 7 is a corresponding top view and FIG. 8 is a corresponding bottom view.
Figure 8:
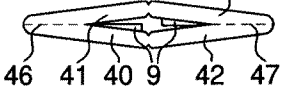

Point P situated at the base of the polygonal prism between faces 52 and 53 thus changes, during unfolding, from position P0 seen in FIG. 9, to position P1, in the alignment of folding crease 46 seen in FIGS. 1, 9 and 11. The polygonal prism thus also changes during the unfolding, with a rhomboid shaped cross-section which expands until the rhomboid becomes a square. In this final position, the other deformable rhomboid formed by edges 48 and 49 is reduced to two flat segments in contact with each other.

The different prisms 40, 41, 42, 43 which occupied different angular positions in space during unfolding, are then all coplanar, and particularly with respect to base face 40 situated on base 30, on which these four prisms rest, clamped on top of each other by the thickness of material, with good stability, provided that the movements imparted to base 30 of box 1 are within angles of less than 30° with respect to the horizontal; otherwise the mass of foldable structure 4 can operate the reverse folding movement of foldable structure 4, when box 1 is empty. When the box is filled with an object 10, any inadvertent folding movement can be prevented by placing the centre of the gravity of the object quite close to base 30.

In the variant illustrated in FIGS. 9 to 13, which is preferred because of its compactness in its flat storage state, as seen in FIG. 9, foldable structure 4 extends, in its flat folded position parallel to base plane P, in a parallel direction to longitudinal direction D. Preferably, in the embodiment with a prism of square cross-section, the folding crease 46 forms an angle of 45° with longitudinal direction D.

Figure 27:
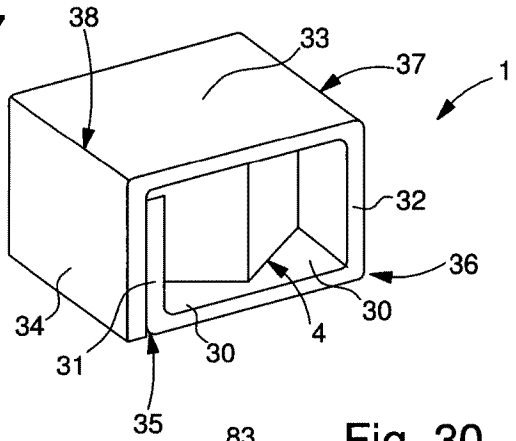
FIGS. 26 and 27 show schematic perspective views of a variant wherein the foldable structure, in the unfolded position, is a prism of hexagonal cross-section.
Figure 26:
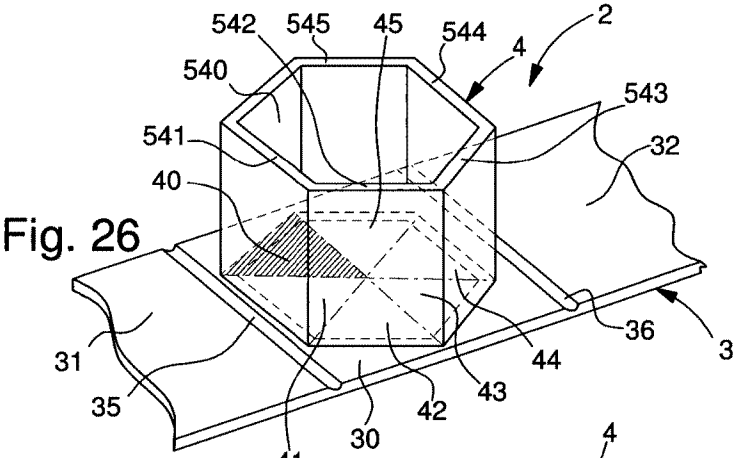
Figure 28:
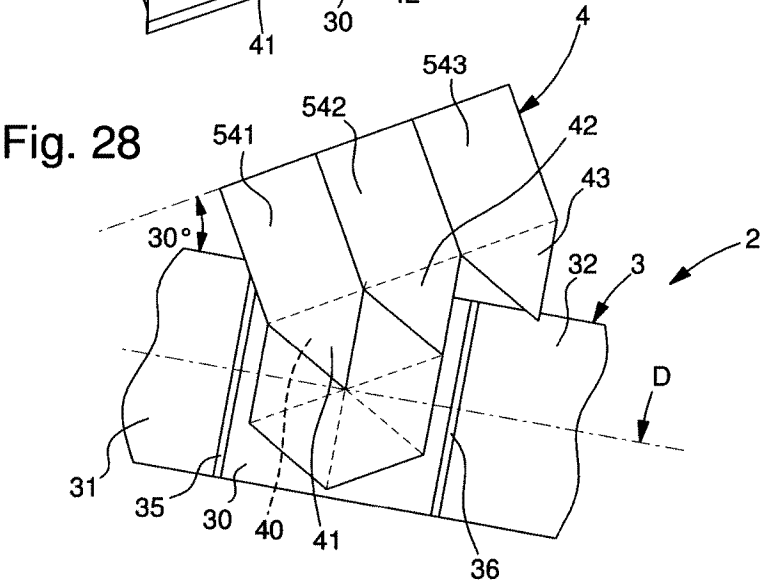
FIG. 28 shows a schematic, partial face view of the flat foldable blank corresponding to FIGS. 26 and 27.

Naturally, this angle depends on the profile of the cross-section of the polygonal prism formed by the unfolded foldable structure 4: for example, FIGS. 26 to 28 illustrate an embodiment wherein the polygonal prism has a regular hexagonal cross-section, base face 40 then has the shape of an equilateral triangle. Foldable structure 40 includes six segments 540, 541, 542, 543, 544, 545, respectively extended by surfaces 40, 41, 42, 43, 44, 45 and is inclined by 30° with respect to longitudinal direction D.

Advantageously, the polygonal prism forms the framework of a rectangular parallelepiped whose base is formed by base 30 and whose cover is formed by a flap 33 comprised in packaging band 3. To this end, preferably, the faces comprised in foldable structure 4 define together, in the unfolded position of foldable structure 4, a plane edge surface 400, which is arranged to act as a support for a flap 33 of packaging band 3. In the embodiment illustrated in the Figures, packaging band 3 includes, at the two ends thereof in longitudinal direction D, two closing flaps 31 and 34 which are arranged to move into superposition one on top of the other when packaging band 3 is in the folded position where it surrounds foldable structure 4 in its stable unfolded position. Closing flaps 31 and 34 include mutually complementary locking means 61 and 62 for holding packaging band 3 in position wrapped around foldable structure 4.

In a first embodiment seen in FIGS. 1 and 11, the mutually complementary locking means 61 and 62 are held together by the thickness of the material forming closing flaps 31 and 34, and include, on the one hand, a mortise type member 63 or cut-out portion, and on the other hand, a tenon type member 64 of complementary profile to that of mortise 63. These mutually complementary locking means 61 and 62 may, in an advantageous variant, be made in the form of inserts made of wear resistant material, such as plastic material or similar, inserted or embedded in flaps 31 and 34 or bonded thereto, or suchlike. This arrangement is particularly advantageous when foldable blank 2 is made of a material such as cardboard, which becomes blunt with use after repeated fastening during closure operations.

The mutually complementary locking means 61 and 62 are illustrated in particular in FIG. 1 with a shaped profile, in this case in the shape of a Swiss cross. Naturally, a simpler shape, such as a rectangle or a circle, may also be employed. A more complex profile may also be suitable, the only constraint being related to the repeated opening and closing operations, which a priori exclude the use of very pointed profiles which could become blunt over time.

In a second embodiment, which may be combined with the first embodiment, as seen in particular in FIG. 1, the mutually complementary locking means 61 and 62 include at least one pole shoe 65 arranged to work in attraction with a complementary pole shoe 66, at least one of pole shoe 65 and complementary pole shoe 66 being formed by a magnet. It is thus possible to place in opposition a magnet and a magnetically permeable metal pole shoe, or two magnets of opposite polarity, In order to hold an object 10 in box 1, in a preferred embodiment according to FIGS. 9, 11 and 13, two opposite faces comprised in foldable structure 4 each include, projecting onto the lower face thereof when foldable structure 4 is in its stable unfolded position, at least one cross support 9, which is arranged to receive a cross member 8 for the reception of an object 10 of this type. This cross member 8 thus has a length equal to the inner space of the faces carrying cross supports 9 so as to reinforce the holding of foldable structure 4 in the stable unfolded position.

This cross member 8 advantageously maintains the geometry of box 1 deployed at right angles, without requiring any additional padding part. Cross member 8 also prevents box 1 inadvertently closing under the effect of the elasticity of its constituent material.

FIG. 15A illustrates a cross member 9 projecting inwards, with a continuous surface 9A for receiving a cross member 8. FIG. 15 also shows a cross support 9 projecting inwards, with a receiving surface 9A which includes an angular position indexing lug 9B, when cross member 8 includes a cut-out portion 87 for performing said indexing.

Figure 30:
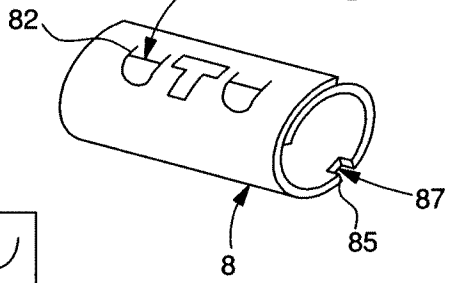
Figure 29:
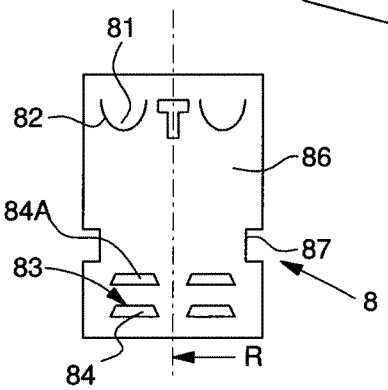
FIG. 29 shows a schematic face view of a flat blank for forming a cross member, which is shown rolled up in FIG. 30.

An economical cross member embodiment is achieved by rolling a blank 86, as seen in FIGS. 29 and 30: blank 86 includes at least, in alignment in a rolling direction R, a tab 81 derived from a cut-out portion 82 represented in a half moon shape here, and an edge 83 derived from another cut-out portion 84, represented here in a substantially rectangular or trapezoidal shape. Blank 86 may include several series of edges 84, 84A . . . , to allow for a diametral adjustment of the rolled cross member 8 of FIG. 30 to the diameter of the object 10 supported by the cross member, particularly a watch: for example different settings are provided for a child's watch, a ladies' watch or a men's watch. For improved stability, the blank advantageously includes, as illustrated, several series of tabs and edges, parallel to direction R. There are two series in the Figures. Rolled cross member 8 defines a bearing surface 85, which cooperates with a receiving surface 9A, as seen in FIG. 15A. Blank 86 may include a peripheral cut-out portion 87 for cooperating with a lug 9B in the case of FIG. 15.

This blank 86, for use as a cross member/cushion, may, like box 1, be made of various materials, depending upon the desired appearance and cost: cardboard, wood, leather, flexible plastic material, or any rollable material having a radius of curvature compatible with the diameter of a watch or a piece of jewellery.

Additionally and as seen in FIGS. 17 and 18, it is possible to add to these cross supports 9, numbered 91 and 92 on two opposite internal faces, a flexible arm 95; at least one cross support 9, 92 in FIG. 17 includes a stop surface 94 arranged to cooperate with one end 98 of a branch 97 of a flexible arm 95, which is fixed by a branch 96 to a securing surface 93 comprised in the face 91 opposite the face carrying cross member 92, so as to hold flexible arm 95 in a buttress position between the opposite faces in the stable, unfolded position of foldable structure 4, to prevent the faces moving closer together. Preferably, securing surface 93 is defined by the projecting protuberance formed by cross support 91, just as stop surface 94 is defined by the projecting protuberance formed by cross member 92.

In a variant, as seen in FIG. 16, two opposite faces comprised in foldable structure 4 each include, aligned when foldable structure 4 is in its stable unfolded position, at least one cut-out portion 99 for housing a cross member, arranged for receiving a cross member 8 for the reception of an object 10, said cross member 8 having a length at least equal to the external space of the faces carrying the cross member housing cut-out portions 99.

Preferably and advantageously, the packaging band 3 and single-piece foldable structure 4 are made of foldable and/or rollable cardboard, foldable blank 2 is obtained by the adhesive bonding or suchlike of foldable structure 4 onto the packaging band, on base face 40 and base 30 and the folds are creased.

A cardboard embodiment of box 1 thus offers very economical production, while allowing for a large variety of decorations. Each cross member 8 may also be made of cardboard, or of an extruded material, for example polyurethane foam or another polymer foam, or rubber, wood or another material.

Foldable blank 2 may also be made of more noble materials, such as leather, or materials such as rubber or some plastic materials, or wood, depending upon the features or style of the part 10 to be packaged.

Naturally, packaging band 3 and foldable structure 4 may be made of different materials, which allows for a large variety of models.

The invention claimed is:

1. A folding box for a packaging of at least one object or piece of jewelry or timepiece, said box comprising:

a foldable blank which includes at least one packaging band extending in a longitudinal direction and movable between a flat, unfolded position in a base plane and a folded position, and on either side of a base, two flaps which are angularly movable in relation to said base, wherein said foldable blank further includes a single-piece foldable structure, said single-piece foldable structure including a base face secured in a permanent manner to said base of the foldable blank or forming said base, and at least two bearing faces, said single-piece foldable structure being movable between a flat, folded position in which said single-piece foldable structure is unassembled and a stable, unfolded position in which said single-piece foldable structure is upright and assembled, said single-piece foldable structure being folded on itself so as to be flat and parallel to said single-piece foldable blank in said flat, folded position, and said at least two bearing faces in said stable, unfolded position of said single-piece foldable structure, are each arranged to receive and support one of said two flaps, wherein said single-piece foldable structure is foldably movable, between said flat, folded position and said stable, unfolded position thereof, around a folding crease which is oblique with respect to said longitudinal direction, said folding crease forming an edge of a base surface, and wherein two opposite faces comprised in said single-piece foldable structure each include, projecting onto the inner face thereof when said single-piece foldable structure is in said stable, unfolded position, at least one cross support, which is arranged to receive a cross member for receiving said object, said cross member having a length equal to an internal space of said two opposite faces carrying said at least one cross support so as to reinforce the holding of said single-piece foldable structure in said stable, unfolded position.

2. The folding box according to claim 1, wherein said single-piece foldable structure includes an even number of visible faces, which are adjacent to said at least two bearing faces and alternated therewith, and form, with said at least two bearing faces, a polygonal prism in said stable, unfolded position of said single-piece foldable structure, and form therewith a closed band foldable on two parallel levels in said flat, folded position of said single-piece foldable structure.

3. The folding box according to claim 2, wherein, in order to ensure a stability thereof in said stable, unfolded position thereof, said single-piece foldable structure includes a plurality of polygonal sectors each adjacent to one of said at least two bearing faces or to one of said even number of visible faces, said plurality of polygonal sectors being, in said stable, unfolded position, joined edge-to-edge to each other, either by folds, or by edges, locking them onto each other over the thickness of the constituent material thereof, and so as to form together a polygonal surface corresponding to the cross-section of said polygonal prism, and further wherein one of said plurality of polygonal sectors is said base face and one of said folds is said folding crease.

4. The folding box according to claim 3, wherein said polygonal prism has a square cross-section, and said plurality of polygonal sectors are mutually identical prisms whose cross-section is a small equilateral rectangular triangle wherein the hypotenuse of each corresponds to a junction fold with a respective face of said single-piece foldable structure.

5. The folding box according to claim 4, wherein said plurality polygonal sectors are connected in pairs by a fold to form each time, in said stable, unfolded position of said single-piece foldable structure, a prism whose cross-section is a large equilateral rectangular triangle whose surface is double said small equilateral rectangular triangles, said two thus formed large triangles being contiguous with each other at two said edges in said stable, unfolded position.

6. Box according to claim 1, wherein said single-piece foldable structure extends, in said flat, folded position parallel to said base plane, in a direction parallel to said longitudinal direction with which said folding crease forms an angle of 45°.

7. The folding box according to claim 2, wherein said polygonal prism forms the framework of a rectangular parallelepiped whose base is formed by said base and whose cover is formed by a flap comprised in said at least one packaging band.

8. The folding box according to claim 1, wherein said at least one packaging band includes, at both ends thereof in said longitudinal direction, two closing flaps arranged to move into superposition on each other when said at least one packaging band is in said folded position surrounding said single-piece foldable structure in the stable, unfolded position of said single-piece foldable structure, said two closing flaps including mutually complementary locking means to ensure said at least one packaging band is held in position wound around said single-piece foldable structure.

9. The folding box according to claim 1, wherein said at least two bearing faces comprised in said single-piece foldable structure define together, in said stable, unfolded position of said single-piece foldable structure, a plane edge surface arranged to act as support for a flap comprised in said at least one packaging band.

10. The folding box according to claim 2, wherein said at least one cross support includes a stop surface arranged to cooperate with one end of a flexible arm fixed to one of said two opposite faces to that carrying said at least one cross support, so as to hold said flexible arm in a buttress position between said two opposite faces in said stable, unfolded position of said single-piece foldable structure, to prevent said two opposite faces moving closer to each other.

11. The folding box according to claim 1, wherein said two opposite faces comprised in said single-piece foldable structure each include, aligned when said single-piece foldable structure is in its stable, unfolded position thereof, at least one cut-out portion for housing a cross member, arranged for receiving said cross member for the reception of an object, said cross member having a length at least equal to an external space of said two opposite faces carrying said cross member housing at least one cut-out portion.

12. The folding box according to claim 8, wherein said mutually complementary locking means are held together by the thickness of the material forming said closing flaps, and include, a mortise type member or cut-out portion and a tenon type member of complementary profile to that of said mortise.

13. The folding box according to claim 8, wherein said mutually complementary locking means include at least one pole shoe arranged to work in attraction with a complementary pole shoe, at least one of said pole shoe and said complementary pole shoe being formed by a magnet.

14. The folding box according to claim 1, wherein said at least one packaging band and said single-piece foldable structure are made of cardboard, and said folds are creased.

15. A folding box for a packaging of at least one object or piece of jewelry or timepiece, said box comprising:

a foldable blank which includes at least one packaging band extending in a longitudinal direction and movable between a flat, unfolded position in a base plane and a folded position, and on either side of a base, two flaps which are angularly movable in relation to said base, wherein said foldable blank further includes a single-piece foldable structure, movable between a flat, folded position in which said single-piece foldable structure is unassembled and parallel to said base plane and a stable, unfolded position in which said single-piece foldable structure is upright and assembled, said single-piece foldable structure including a base face secured in a permanent manner to said base or forming said base, and at least two bearing faces which, in said unfolded position of said single-piece foldable structure, are each arranged to receive and support one of said two flaps, wherein said single-piece foldable structure is foldably movable, between said flat, folded position and said stable, unfolded position thereof, around a folding crease which is oblique with respect to said longitudinal direction, said folding crease forming an edge of a base surface, wherein two opposite faces comprised in said single-piece foldable structure each include, projecting onto the inner face thereof when said single-piece foldable structure is in said stable, unfolded position, at least one cross support, which is arranged to receive a cross member for receiving said object, said cross member having a length equal to an internal space of said two opposite faces carrying said at least one cross support so as to reinforce the holding of said single-piece foldable structure in said stable, unfolded position, wherein said single-piece foldable structure includes an even number of visible faces, which are adjacent to said at least two bearing faces and alternated therewith, and form, with said at least two bearing faces, a polygonal prism in said stable, unfolded position of said single-piece foldable structure, and form therewith a closed band foldable on two parallel levels in said flat, folded position of said single-piece foldable structure, and wherein, in order to ensure a stability thereof in said stable, unfolded position thereof, said single-piece foldable structure includes a plurality of polygonal sectors each adjacent to one of said at least two bearing faces or to one of said even number of visible faces, said plurality of polygonal sectors being, in said stable, unfolded position, joined edge-to-edge to each other, either by folds, or by edges, locking them onto each other over the thickness of the constituent material thereof, and so as to form together a polygonal surface corresponding to the cross-section of said polygonal prism, and further wherein one of said plurality of polygonal sectors is said base face and one of said folds is said folding crease.

16. The folding box according to claim 15, wherein said polygonal prism has a square cross-section, and said plurality of polygonal sectors are mutually identical prisms whose cross-section is a small equilateral rectangular triangle wherein the hypotenuse of each corresponds to a junction fold with a respective face of said single-piece foldable structure.

17. The folding box according to claim 16, wherein said plurality polygonal sectors are connected in pairs by a fold to form each time, in said stable, unfolded position of said single-piece foldable structure, a prism whose cross-section is a large equilateral rectangular triangle whose surface is double said small equilateral rectangular triangles, said two thus formed large triangles being contiguous with each other at two said edges in said stable, unfolded position.

* * * * *